United States Patent [19]

Hashimoto

[11] 4,218,153

[45] Aug. 19, 1980

[54] MECHANICAL PENCIL

[75] Inventor: Yasuyuki Hashimoto, Nishinomiya, Japan

[73] Assignee: Ancos Co., Ltd., Osaka, Japan

[21] Appl. No.: 25,525

[22] Filed: Mar. 30, 1979

[30] Foreign Application Priority Data

Apr. 1, 1978 [JP] Japan ..... 53-37457

[51] Int. Cl.[2] ..... B43K 21/22

[52] U.S. Cl. ..... 401/67

[58] Field of Search ..... 401/67, 57, 75, 85

[56] References Cited

U.S. PATENT DOCUMENTS

| | | | |
|---|---|---|---|
| 3,724,960 | 4/1973 | Hashimoto et al. | 401/67 |
| 3,728,033 | 4/1973 | Seta et al. | 401/67 |
| 4,106,874 | 8/1978 | Torii | 401/67 |
| 4,149,813 | 4/1979 | Katz et al. | 401/67 X |

*Primary Examiner*—John D. Yasko

*Attorney, Agent, or Firm*—Sughrue, Rothwell, Mion, Zinn and Macpeak

[57] ABSTRACT

A mechanical pencil having first and second rotatable body members and a slider mounted for retractable movement in one of the members. The slider has an axial retainer for frictionally gripping the lead. A lead case is disposed within one body member having a lead gripping chuck connected to one end. A chuck tightening mechanism advances and tightens the chuck to supply lead to the slider having a predetermined length. Rotation of the two body members relative to each other is translated into a corresponding movement to the chuck tightening mechanism. A resilient or magnetic member may be placed in the slider to maintain contact with the tightening mechanism.

8 Claims, 6 Drawing Figures

MECHANICAL PENCIL

BACKGROUND OF THE INVENTION

This invention relates to a rotational slide type mechanical pencil in which a slider holding a lead is retractable and extendable in and out of a mouth opening of the mechanical pencil body.

A rotation lead feeding type of mechanical pencil has been frequently used and is well known. However, the rotation lead feeding mechanical pencil has the following disadvantages:

(1) Both hands are required to hold the pencil to provide a lead at the mouth end of the mechanical pencil;

(2) An axial body member must be rotated, confirming an extending length of the lead;

(3) A new lead must be inserted from the mouth opening into the mechanical pencil to supply a new lead;

(4) Since a lead is liable to be broken in a new lead supply, a thin lead cannot be used.

Due to the above disadvantages, the rotation lead feeding type mechanical pencil is not used as often as it was several years ago. Instead, recently, a step-by-step knocking type mechanical pencil has been introduced and is frequently used. However, the knocking type mechanical pencil has the significant disadvantage in that the mechanism thereof deteriorates due to a knocking cap. In order to overcome this, a slide cap type mechanical pencil has been provided. However, the slide cap type mechanical pencil has also significant disadvantages since a reciprocatingly movable cap per se is moved forward and backward with every knock and the cap is contacted to the gripping hand making it difficult to handle it.

On the other hand, a rotation lead feeding type mechanical pencil is still used in parts of the world especially in Europe and the U.S. Some big companies therein still make the rotation lead feeding type because a rotation type has an image of a high class article. Also a rotation type of device despite its inherent disadvantages generally has a long service life.

SUMMARY OF THE INVENTION

The present invention provides a novel mechanical pencil while maintaining a high class article image, to overcome the above described disadvantages inherent to the rotational lead feeding type. Further, a rotation slide type mechanical pencil according to the present invention has the advantages of a knocking type.

It is therefore an object of this invention to provide for an improved mechanical pencil lead feeding mechanism.

It is another object of this invention to provide for an improved mechanical pencil having a feeding mechanism that eliminates the disadvantages of a rotational lead feeding device while maintaining the advantages of a knocking type of advancing mechanism.

Yet another object of this invention is to provide a mechanical pencil having improved operation and useable life by eliminating components susceptible of breakdown.

These and other objects of this invention are achieved by a mechanical pencil having first and second rotatable body members and a slider mounted for retractable movement in one of the members. The slider has an axial retainer for frictionally gripping the lead. A lead case is disposed within one body member having a lead gripping chuck connected to one end. A chuck tightening mechanism advances and tightens the chuck to supply lead to the slider having a predetermined length. Rotation of the two body members relative to each other is translated into a corresponding movement to the chuck tightening mechanism. A resilient or magnetic member may be placed in the slider to maintain contact with the body member.

This invention will be described with respect to the drawings and the description of the preferred embodiment that follow.

BRIEF DESCRIPTION OF THE DRAWINGS

FIG. 2(*b*) shows an enlarged view of the structural members of the first embodiment.

DETAILED DESCRIPTION OF THE PREFERRED EMBODIMENT

Figure 1:
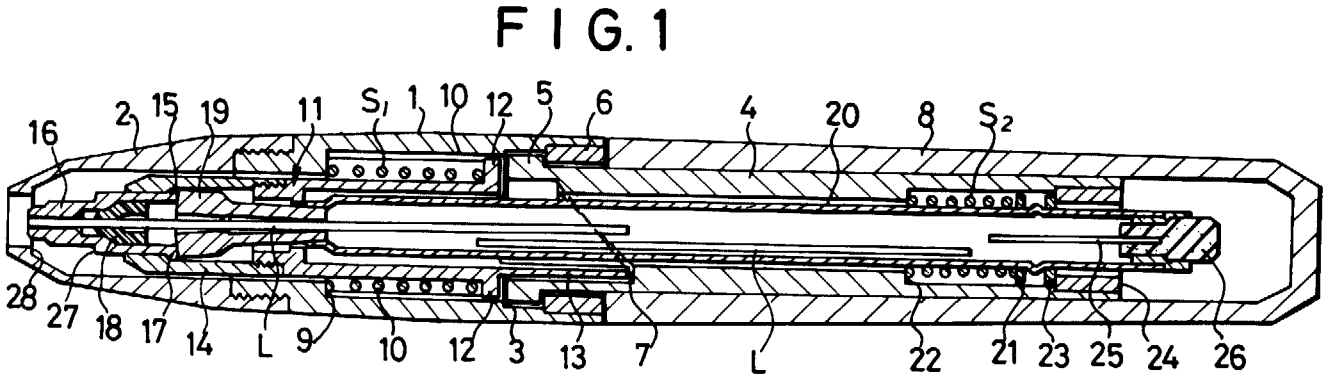
FIGS. 1, 3 and 4 show longitudinal sectional view of the first embodiment according to the present invention.
Figure 2A:
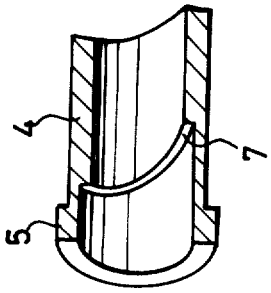
FIG. 2(*a*) shows perspect and cross sectional views of a primary part of the first embodiment.
Figure 2B:
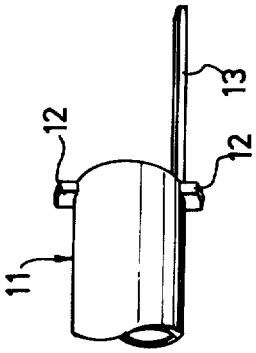
Figure 2B:
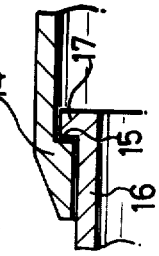

FIG. 1 shows a first embodiment of a mechanical pencil, according to the present invention, shown in a storage configuration, that is, not in use. L designates a lead. As shown, lead is stored within the pencil body and fed from the rear. Reference numeral 1 designates a front axial body. A mouth member 2 is fixedly and threadedly engaged with a front portion of the front axial body 1. A rotary cylinder 4 is inserted into a rear inner portion of the main body 1 abutting to a shouldered portion 3 formed in the front body 1. A flange portion 5 is formed at a front end of the rotary cylinder 4. Further, a retaining ring 6 is press-fitted to the rear inner end portion of the front body 1 to thereby prevent disengagement between the front body 1 and the rotary cylinder 4. A slant cam surface 7 is formed in a front inner portion of the rotary cylinder 4 as shown in FIG. 2(*a*). The rotary cylinder 4 is substantially surrounded by a rear axial body 8. A body of the mechanical pencil is therefore constructed of the mouth member 2, the front axial body 1 and the rear axial body 8.

An annular shouldered portion 9 is formed in an inner surface of the front body 1. Longitudinal guide grooves 10 are formed from the shouldered portion 9 extending rearwardly. A chuck tightening member 11 is disposed in the front body 1. Projections 12 which are formed in a peripheral end surface of the tightening member 11 are slidably engaged with the longitudinal grooves 10.

As shown in FIG. 2(*a*), a rod portion 13 extends from the rear end of the tightening member 11. The rod portion 13 is forwardly and backwardly moved while the rear end of the rod portion 13 slides on the slant cam surface 7 as a result of the rotation of the rotary cylinder 4. A first spring $S_1$ is disposed between the shouldered portion 9 of the front body 1 and the projections 12 of the tightening member 11 to bias the tightening member 11 to move backward. Alternatively, spring $S_1$ can be omitted, for example, if spiral grooves are formed in an outer surface of the rotary cylinder. In that case, the projections, 12, formed on the tightening member would slidably engage with the spiral grooves, respectively and then the rotary cylinder is rotated not only to advance the tightening member 11 but also to thereby forcibly retract it. For example, a helicoid mechanism can be used instead of a spring $S_1$ mechanism.

A cylindrical sleeve 14 is threadedly engaged with the tightening member 11. A shouldered portion 15 is formed at the front inner portion of the cylindrical sleeve 14 (refer to FIG. 2(*b*)). A slider 16 is inserted into the hollow portion of the cylindrical sleeve 14 in a manner such that a flange 17 (FIG. 2(*b*)) formed at the rear end of the slider 16 abuts with the shouldered portion 15 of the cylindrical sleeve 14 to prevent the slider 16 from dropping out of the cylindrical sleeve 14. A lead retainer 18 is disposed within the slider 16. The lead retainer 18 is made of elastic materials such as a rubber and a synthetic resin and always holds the lead slightly. The slider 16 projects from the opening at the top end of the mouth member 2 and the cylindrical sleeve 14. Many modifications of the structures of the cylindrical sleeve 14, the slider 16 and the tightening member 11 can be used. Such structure is only necessary in terms of function such that the slider 16 is retractable toward the tightening member 11 and is not advanced above a predetermined length from the tightening member 11. The invention is not limited to the specific embodiment of the cylindrical sleeve and slider.

A lead gripping chuck 19 is disposed within the cylindrical sleeve 14 and the tightening member 11. A rear end of the chuck 19 is coupled to a lead case 20. An annular ring 21 is secured to the outer rear periphery of the lead case 20. A second spring $S_2$ is disposed between the annular ring 21 and a shouldered portion 22 formed in the rear portion of the rotary cylinder 4. The spring $S_2$ urges the lead case 20 to move rearward. The spring $S_2$ imparts a lead holding force to the chuck 19. Another annular ring 23 is secured to the outer rear periphery of the lead case 20. A stopper ring 24 is secured to the inner peripheral end of the rotary cylinder 4. Thus, when the lead case 20 is moved backward, the lead case is stopped by the abutment between the stopper ring 24 and the annular ring 23. As is clear from FIG. 1, when the mechanical pencil is not used and in the retracting condition, by the action of the spring $S_2$ the annular ring 23 is in abutment with the stopper ring 24 with the lead released from the chuck 19. An eraser 26 having a cleaner pin 25 is inserted into an opening of the lead case 20.

The constructed mechanical pencil as described is used in writing as follows. First, the front end of the mechanical pencil is directed downward. The front axial body 1 is gripped by one hand while the rear axial body 8 is rotated by the other hand. The rotary cylinder 4 is located together with the rear body 8. The rear end of the extending rod 13 is pushed and slid on the slant cam surface 7 to thereby advance the tightening member 11. The tightening member 11 and the cylindrical sleeve 14 are advanced while the spring $S_1$ is compressed. At this time, since the projections 12 slide along the guide grooves 10, neither the tightening member 11 nor the cylindrical sleeve 14 is rotated. As the cylindrical sleeve 14 is advanced, the slider 16 which holds the lead through the lead retainer 18 is also advanced by the gravity. That is, since the lead is not gripped by the chuck 19, according to the advance of the slider 16, the lead is projected from the chuck 19 due to the lead retainer 18. Then, the chuck 19 is clamped by the tightening member 11 to thereby fix the lead in the chuck 19. Thereafter, while the spring $S_2$ is gradually compressed, the slider 16, the cylindrical sleeve 14, the tightening member 11, the chuck 19, the lead case 20 and the lead are all advanced.

Figure 3:
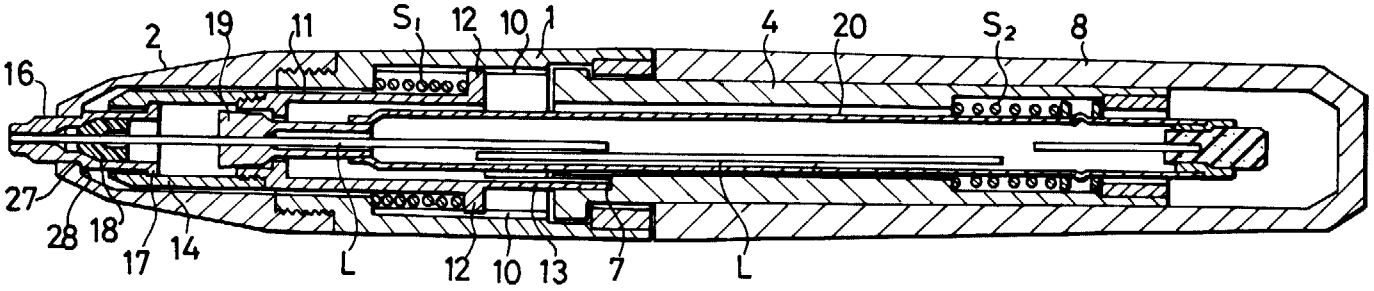
Figure 4:
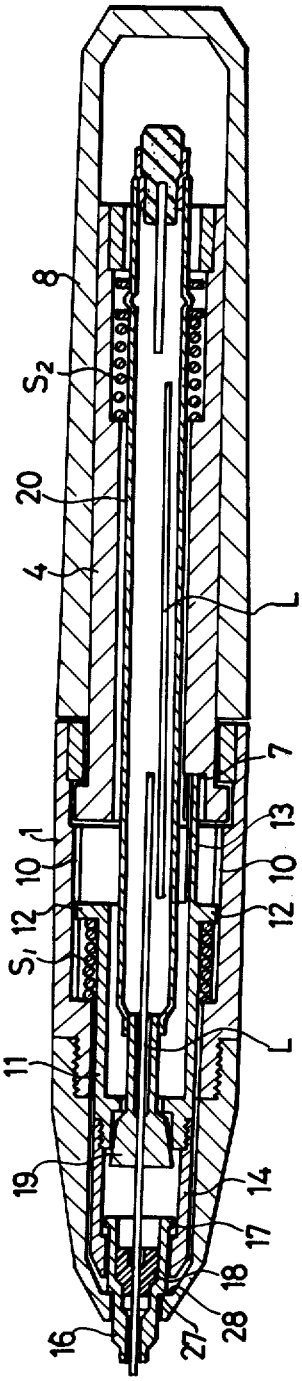

However, only the slider 16 can not be advanced further then a position where a shouldered portion 27 formed in the outer periphery of the slider 16 abuts shouldered portion 28 of the mouth member 2 (refer to FIG. 3). Therefore, the cylindrical sleeve 14, tightening member 11, the chuck 19 and the lead case 20 are still further advaced while the slider 16 remains fixed in the outward position. At this time, though the lead is retained by the lead retainer 18, because the lead is gripped by the chuck 19 the lead is advanced against the retaining resistance of the retainer 18 to thereby extend from the opening of the mouth member 2. Finally, when the rear end of the extending rod 13 is positioned at the foremost position of the slant cam surface 7, the rotary cylinder 4 is stopped. All members such as the tightening member 11 are stopped as shown in FIG. 4. The front end of the slant cam surface is formed into a plane surface in order to retain the extending rod 13.

Hence, when the rear axial body 8 is fully rotated, the slider 16 is at the fully advanced position and the predetermined length of the lead is fed out of the slider 16 for a smooth writing condition. If the end of the slider 16 is at the same level as that of the lead end as shown in FIG. 3, in writing, the slider 16 directly touches a writing paper surface so that in the initial stage of writing, the writing feeling deteriorates. However, if the lead end slightly protrudes from the slider 16 as shown in FIG. 4, the writing feeling is very excellent in the initial writing action.

Further, if the writing is continuous in the state shown in FIG. 4, at first the lead projected from the slider 16 is worn out and then the slider 16 is gradually moved backward by the contact of the paper surface as the lead is abraded. Therefore, without any additional operation, until the slider is fully retracted, the user can continue writing. In this case, since the lead is protected by the slider 16, the lead is not broken.

In continuous writing, when the slider 16 is retracted to some extent, if the rear body 8 is rotated in the opposite direction, the tightening member 11 and the cylindrical sleeve 14 are retracted by the spring $S_1$ and the chuck 19 and the lead case 20 are also retracted by the spring $S_2$ to return to the original state shown in FIG. 1. Thereafter, the rear body 8 may be rotated so that a new lead is fed as shown in FIG. 4. In this case, irrespective of the extent that the slider 16 is retracted on the lead, the slider 16 is always advanced to the predetermined position to provide a new lead having the predetermined length from the opening of the slider 16 end.

As shown in FIGS. 1–4, lead L is stored within the case 20. When the lead held in the chuck 19 reaches a length to not entirely protrude back into the case 20, additional leads are channeled into the chuck by means of the tapered portion 30, shown in FIG. 4. Hence, when the pencil is pointed downward, lead in the case 20 will be moved along the taper 30 until one piece enters the chuck. As a result, new leads are continuously fed from the rear of the pencil, overcoming a serious shortcoming of the prior art.

In some cases the slider 16 is unnecessary, for example, where soft paper is used to be written on and it is possible to continue writing by inching the lead, as in an ordinary mechanical pencil which is not a slide-type, by the easy operation where the rear body 8 is slightly rotated in the opposite direction and is rotated to the original position. That is, when the rear body 8 is slightly rotated in the direction opposite to the lead feeding direction, in the initial stage, the slider 16, the cylindrical sleeve 14, the tightening member 11, the cnuck 19, the lead case 20 and the lead clamped by the chuck 19 are bodily moved backward. However, immediately, the ring 23 on the rear portion of the lead case 20 abuts the stopper ring 24 to prevent the further movement of the lead case 20.

On the other hand, the tightening member 11 is further moved backward by the spring force of the spring $S_1$ together with the cylindrical sleeve 14 to thereby release the lead from the chuck 19. At this time, the slider 16 is advanced by the gravity within the cylindrical sleeve 14 while the lead is fed from the chuck 19 due to the retaining force of the retainer 18 until the flange 17 of the slider 16 abuts the shouldered portion 15 of the cylindrical sleeve 14. Next, the rear body 8 is returned to the original feeding position. As the chuck 19 is opened, at first, the lead, the slider 16, the cylindrical sleeve 14 and the tightening member 11 are advanced. When the tightening member 11 is engaged with the chuck 19, the chuck 19 clamps the lead and both are advanced. However, the slider 16 is prevented from advancing since the shouldered portion 27 thereof abuts the shouldered portion 28 of the mouth member 2. Thereafter, the cylindrical sleeve 14, the tightening member 11, the chuck 19 and the lead clamped by the chuck 19 are bodily advanced. A new lead is supplied from the opening of the slider 16 to the extent as the advancing length of the other members. Accordingly, in continuous writing with successively providing a new lead from the opening of the slider 16 or when the slider 16 is retracted into the mechanical pencil by writing is returned to the original position with a new fed lead, a very slight opposite rotation of the rear body 8 to release the lead from the chuck 19 and an immediate rotation to return the rear body 8 to the initial position are the only required actions to achieve this result.

When writing is finished, if the rear body 8 is rotated in the opposite direction to the first position, the force to push the end of the extending rod 13 is eliminated and the force of the spring $S_1$ is applied to the tightening member 11 and the cylindrical sleeve 14 to be moved backward. At the same time the slider 16 and the lead are moved backward. The force of the spring $S_2$ is applied to the chuck 19 and the lead case 20 to be moved backward. Then, the pencil is in the state as shown in FIG. 1. In the lead retracting state, the chuck 19 does not clamp the lead. Therefore, there is no possibility that the lead will broken even in an impulse during the carrying and non-use states by having a clamping point along the length of the head.

As mentioned above, the structure and the resultant effect of the embodiment of the present invention are achieved by the apparatus shown in FIGS. 1–4.

The above-described embodiment can be improved since, as indicated the tip opening of the mechanical pencil must be directed downward and the rear body 8 must be rotated for a leed supply. If the tip opening of the mechanical pencil is directed upward and the rear body 8 is rotated, the slider 16 is drawn rearward by the gravity. Therefore, a problem results in that the slider 16 is moved forwardly with some difficulty. That is to say, in case that the front end of the mechanical pencil is directed upward, as long as the chuck 19 is opened, the slider 16 will drop down together with the lead in the backward direction. Accordingly, only after the chuck 19 is clamped by the tightening member 11, it is possible to advance the lead clamped by the chuck 19 with the retainer 18. Therefore, it is impossible in this condition to appropriately advance the slider 16.

Figure 5:
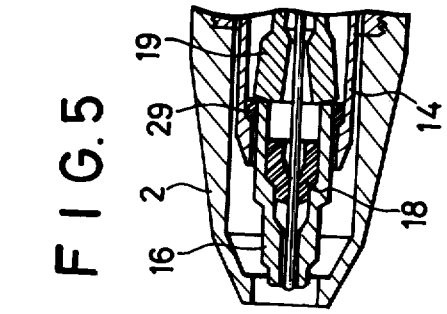
FIG. 5 shows a sectional view of a primary part of the second embodiment according to the present invention.

FIG. 5 is a second embodiment according to the present invention to overcome the above-noted deficiency. A retainer 29 made of an elastic material such as rubber is provided on the rear end of the slider 16 in place of the flange 17. The retainer may also be positioned on the sleeve 14 at the shoulder 15. In the lead retracting state of the thus constructed mechanical pencil as shown in FIG. 5, the slider 16 is prevented from being moved backward by the abutment between the front end of the chuck 19 and the slider 16. Hence, the slider 16 is retained in the cylindrical member 14 as shown in FIG. 1 due to the provision of the retainer 29. In this state, when the rear body 8 is rotated, the cylindrical member 14 serves to advance the slider 16 therewith. That state is shown in FIG. 3. As the shouldered portion 27 of the slider 16 abuts with the shouldered portion 28 of the mouth member 2, the retaining or support of the cylindrical member is not released. Thereafter, the state shown in FIG. 4 is realized.

A magnet may also be suitable to retain the slider 16 to the cylindrical member 14 instead of a rubber member and can be used in the same relative location. A retaining force must be smaller than a force due to writing pressure and larger than a force due to gravities of the slider 16 and the lead retained therein. With such a retaining force of the retainer, the slider is always grasped by the cylindrical member 14. Therefore, many modifications concerning retainer 29 can be used.

The two specific embodiments of the present invention have been described. However, the spirit and scope of the present invention are not limited thereto. Many modifications may be used. For example, though a mechanism for advancing or retracting the tightening member 11 is constructed so that the extending rod 13 extending from the tightening member 11 biased to move backward by the springs $S_1$ is moved forward and backward along the slant cam surface 7 formed in the rotary cylinder 4, a slant cam surface may be formed in the tightening member 11 and an extending rod may be formed extending from the rotary cylinder 4. A helicoid groove may be formed in the outer periphery of the tightening member 11 and a projection may be formed in the inner periphery of the rotary cylinder 4 to engage the groove and the projection with each other. Otherwise, a groove may be formed in the inner periphery of the rotary cylinder 4 and a projection may be formed in the outer periphery of the tightening member 11 to engage both elements. As mentioned before, in this case, the spring $S_1$ for urging the tightening member 11 to be moved backward is unnecessary. Various mechanisms for an ordinary rotational lead advancing mechanical pencil can be, of course, used.

As mentioned above, any mechanism for advancing or retracting the tightening member by the rotation of the mechanical pencil body can be used. A position where the mechanism is installed is not limited. In the embodiment, the rear body 8 can be rotated. However, either of the front or rear body can be rotated to advance or retract the tightening member.

As is clear from the above, the present invention relates to a rotation lead advancing type mechanical pencil. However, a mechanism for a step-by-step knocking type mechanical pencil rather for a rotational one is adopted for the present invention. Therefore, the present invention will provide the following advantages.

(1) An external image of an expensive and excellent feeling of the rotational mechanical pencil is present in the configuration;

(2) Not only a new lead can be advanced together with the slider, but a lead having a predetermined length from the opening of the slider can be supplied;

(3) A new lead can be automatically supplied from the lead case;

(4) A mechanical pencil having a longer useable life is achieved since the knocking head is unnecessary;

(5) Accidental lead breakage can be prevented since the lead is not clamped by the chuck in the non-use and carrying states.

What is claimed is:

1. A mechanical pencil comprising:

a main hollow body comprising a first body member and a second body member, said second body member having a mouth opening at an end thereof, said first body member being rotatable with respect to said second body member and said first and second body members engaging each other, a slider retractable in said mouth opening, said slider having a lead retainer for frictionally gripping lead and an opening through which lead protrudes, a lead case for storage of extra leads therein, biasing means for biasing said lead case for movement in one direction, a lead gripping chuck connected at one end of said lead case, means for receiving and tightening said chuck and for advancing the chuck with said means to supply a new lead having a predetermined length from the opening of the slider, and means for converting the rotational movement of said first body member to reciprocating movement of means for said tightening said chuck, whereby a new lead is supplied from the opening of the slider by rotation of the first body member.

2. A mechanical pencil as claimed in claim 1, wherein said means for receiving and tightening said chuck comprises a cylindrical body member biased to be moved backward, a chuck tightening member for tightening said chuck and a cam contact extending member.

3. A mechanical pencil as claimed in claims 1 or 2, further comprising second biasing means for biasing said chuck tightening member in a direction away from said slider.

4. A mechanical pencil as claimed in claim 2, further comprising a member provided relative to the rear end of the slider wherein the slider is supported at the front portion of said means for receiving and tightening.

5. A mechanical pencil as claimed in claim 4 wherein said member is a resilient material positioned at the rear end of said slider, and said means for receiving and tighting comprises an annular sleeve supporting said slider and engaging said resilient material.

6. A mechanical pencil as claimed in claim 4 wherein said means for receiving and tightening said chuck comprises an annular sleeve supporting said slider, said member comprising a resilient material positioned on said annular sleeve and engaging said slider.

7. A mechanical pencil as claimed in claim 4 wherein said means for receiving and tightening comprises an annular sleeve supporting said slider and said member comprises a magnetic member holding said slider onto said sleeve.

8. A mechanical pencil as claimed in claim 1 wherein said lead case comprises a circular shell, and a sleeve portion engaging said chuck at one end providing a passage for lead into said chuck.

* * * * *